US008653974B2

(12) United States Patent
Crook

(10) Patent No.: US 8,653,974 B2
(45) Date of Patent: Feb. 18, 2014

(54) INTERFACE BETWEEN AN OBJECT SUCH AS A FIREARM AND AN ALARM OR MONITORING SYSTEM

(76) Inventor: D. Wayne Crook, Belton, TX (US)

( * ) Notice: Subject to any disclaimer, the term of this patent is extended or adjusted under 35 U.S.C. 154(b) by 865 days.

(21) Appl. No.: 12/774,571

(22) Filed: May 5, 2010

(65) Prior Publication Data

US 2010/0321186 A1 Dec. 23, 2010

Related U.S. Application Data

(60) Provisional application No. 61/269,157, filed on Jun. 22, 2009, provisional application No. 61/340,583, filed on Mar. 19, 2010.

(51) Int. Cl.

| | |
|---|---|
| ***G08B 29/00*** | (2006.01) |
| ***G08B 1/08*** | (2006.01) |
| ***E05B 45/06*** | (2006.01) |
| ***G08B 13/14*** | (2006.01) |
| ***G08B 13/08*** | (2006.01) |
| ***G08B 17/06*** | (2006.01) |
| ***F41C 33/02*** | (2006.01) |
| ***B65D 25/04*** | (2006.01) |
| ***F41A 17/00*** | (2006.01) |
| ***F41A 35/04*** | (2006.01) |

(52) U.S. Cl.

USPC ..... 340/568.6; 340/506; 340/539.23; 340/539.31; 340/542; 340/568.1; 340/572.9; 340/547; 340/593; 224/244; 224/245; 42/70.01; 42/96

(58) Field of Classification Search

USPC ..... 340/56

See application file for complete search history.

(56) References Cited

U.S. PATENT DOCUMENTS

| | | | | |
|---|---|---|---|---|
| 3,530,451 | A * | 9/1970 | Devine | 340/539.11 |
| 4,155,608 | A * | 5/1979 | Orlewicz | 312/204 |
| 4,162,521 | A * | 7/1979 | Snyder | 362/113 |
| 4,896,140 | A * | 1/1990 | Biever et al. | 340/568.2 |
| 5,108,019 | A * | 4/1992 | Woodward et al. | 224/243 |
| 5,374,919 | A | 12/1994 | Zelka et al. | |
| 5,525,966 | A * | 6/1996 | Parish | 340/568.1 |
| 5,805,066 | A * | 9/1998 | Murdy | 340/568.1 |
| 5,828,301 | A * | 10/1998 | Sanchez | 340/539.1 |
| 5,916,087 | A * | 6/1999 | Owens | 5/503.1 |
| 6,400,269 | B1 | 6/2002 | Savastano | |
| 6,429,769 | B1 | 8/2002 | Fulgueira | |
| 6,568,116 | B2 * | 5/2003 | Hathaway | 42/70.11 |
| 6,674,358 | B1 * | 1/2004 | Tinsley | 340/7.63 |

(Continued)

*Primary Examiner* — Daniel Wu
*Assistant Examiner* — Muhammad Adnan
(74) *Attorney, Agent, or Firm* — The Culbertson Group, PC; Russell D. Culbertson

(57) ABSTRACT

An interface device includes an elongated sensor strap having a secured end and an unsecured end opposite to the secured end. The unsecured end of the sensor strap represents a first sensor half, and a second sensor half is adapted to receive the first sensor half/unsecured end to form a sensor link between the two sensor halves. A deployment sensor switch provides an input to a monitoring device for an alarm system. The deployment sensor switch is adapted to reside in an armed state when the first and second sensor halves form a sensor link, but change to an alarm state when the first sensor half and second sensor half are separated to break the sensor link. The sensor strap is sufficiently long to produce a closed loop around a firearm or other object to in a monitored position when the first and second sensor halves are placed together to form the sensor link.

18 Claims, 6 Drawing Sheets

(56) References Cited

U.S. PATENT DOCUMENTS 7,053,774 B2 * 5/2006 Sedon et al. ..... 340/568.2
7,619,519 B2 * 11/2009 Richter ..... 340/568.8
7,778,005 B2 * 8/2010 Saliga ..... 361/232

* cited by examiner

INTERFACE BETWEEN AN OBJECT SUCH AS A FIREARM AND AN ALARM OR MONITORING SYSTEM

CROSS REFERENCE TO RELATED APPLICATIONS

The Applicant claims the benefit, under 35 U.S.C. §119(e), of U.S. Provisional Patent Application Ser. No. 61/269,157, filed Jun. 22, 2009, entitled "Handgun Tamper and Deployment Annunciator," and of U.S. Provisional Patent Application Ser. No. 61/340,583, filed Mar. 19, 2010, entitled "Firearm Tamper Switch." The entire content of each of these provisional applications is incorporated herein by this reference.

TECHNICAL FIELD OF THE INVENTION

The present invention relates to an interface to an alarm or monitoring system, and, more particularly, to an alarm or monitoring system interface especially for objects such as firearms. The invention includes devices for providing an input signal to an alarm or monitoring system and to methods for providing such input signals.

BACKGROUND OF THE INVENTION

While firearms remain popular in many jurisdictions for self-defense or sporting uses, appropriate storage for firearms has historically been problematic. One problem regarding firearm storage is specific to self-defense use or law enforcement use. On the one hand, a self-defense firearm or law enforcement firearm should be stored in a way that prevents unauthorized access. However, a firearm intended for self-defense use or for law enforcement use must be readily accessible to an authorized user and maintained in a loaded condition in which the firearm may be deployed quickly if necessary. These seemingly contradictory requirements have proven difficult to meet.

Another problem arises particularly with both self-defense firearms and firearms intended for sporting uses. This problem is that since a firearm may be stored for extended periods of time between uses, an unauthorized removal of the firearm may go undetected for a long period of time.

Prior attempts to address the problems associated with storing a firearm, particularly firearms intended for self-defense use, fall into two broad categories. A first category of firearm storage arrangements involves some sort of lock or barrier which either blocks access to the firearm or at least prevents the firearm from being used even though it may be accessed. These lock or barrier arrangements, while generally effective at preventing unauthorized access or use of the stored firearm, are ineffective at allowing quick access to an authorized user.

The other broad category of firearm storage arrangements for self-defense firearms includes alarm or notifying systems which provide the authorized user with a notification of some type when a stored firearm is accessed. U.S. Pat. No. 6,400,269 provides an example of a notification-type firearm storage arrangement. This patent discloses a firearm display case equipped with an alarm. The firearm fits into a recess in the case, and may be protected by a cover. In the event the cover is lifted, or the firearm is removed from its recess, the device activates an alarm, and may send an alert to home security personnel. However, the case requires that the owner remove the cover first before accessing the firearm. Also, the pressure sensitive switch employed in this device to provide a signal when the firearm is lifted from the recess, and the recess itself is specific to a particular size and shape of firearm, or at least specific to firearms within a certain range of size and shape. Thus different models of the case shown in U.S. Pat. No. 6,400,269 are required to accommodate different types of firearms.

U.S. Pat. No. 6,568,116 discloses another notification storage arrangement for a pistol. In the device shown in U.S. Pat. No. 6,568,116, the lower end of the pistol grip fits snugly into a receptacle to hold the pistol in an upright position. If the pistol is removed from the mount, a pressure-activated switch opens to activate a local alarm, or send an alarm signal to a remote monitoring center. Because the device shown in U.S. Pat. No. 6,568,116 relies on a tight fit between the lower end of the pistol grip and the receptacle, the device suffers from lack of compatibility similarly to the device shown in U.S. Pat. No. 6,400,269. That is, the mount in U.S. Pat. No. 6,568,116 must be specific to a particular size and shape range and thus different models of the mount must be available to accommodate different pistols.

SUMMARY OF THE INVENTION

The present invention encompasses an interface providing an interface between an alarm or monitoring system and an object such as a firearm. The interface device allows rapid access to the object and cooperates with an alarm or monitoring system to provide immediate notification when the object is moved from its stored position. When employed as an interface between an alarm system and a firearm, an interface according to the present invention has the advantage that it may be used with firearms of different size, shape, and configuration.

In one embodiment, which may referred to as a "strap-type" embodiment, an interface device embodying the principles of the invention includes an elongated sensor strap having a secured end and an unsecured end opposite to the secured end. The unsecured end of the sensor strap represents a first sensor half, and a second sensor half is adapted to receive the first sensor half/unsecured end to form a sensor link between the two sensor halves. A deployment sensor switch, which is associated with either the first sensor half, the second sensor half, or both sensor halves, provides an input to a monitoring device for an alarm or monitoring system. The deployment sensor switch is adapted to reside in an armed state when the first and second sensor halves form a sensor link. However, when the first sensor half and second sensor half are separated to break the sensor link, the deployment sensor switch changes to an alarm state.

The sensor strap in the strap-type embodiment is sufficiently long so that when the first and second sensor halves are placed together the sensor strap produces a closed loop around a firearm or other object resting in a monitored position. When the firearm or other object is removed from its monitored position, the movement moves the sensor strap as well. If the sensor strap is moved so that the unsecured end representing the first sensor half is moved beyond an operational tolerance with respect to the second sensor half, the movement of the sensor strap breaks the sensor link between the first and second sensor halves. Breaking the sensor link causes the deployment sensor to move to its alarm state. This transition from the armed state to the alarm state of the deployment switch may be detected by an alarm or monitoring system operatively connected to the deployment sensor, and may be used by the alarm or monitoring system as a basis for initiating an appropriate reaction.

In one preferred embodiment of the strap-type form of the interface device, the secured end of the sensor strap is secured to a base which provides a support surface on which the object to be monitored may be placed. In this embodiment, the second sensor half may include a feature in or on the storage surface of the base. This form of the interface device may additionally include a base tamper switch which transitions from one condition to another if the base is removed from a surface upon which it is resting, even if the object being monitored has not been removed from the base storage surface. The base in this form of the invention provides a convenient location for housing a wireless transmitter of an alarm or monitoring system. The wireless transmitter may be operatively connected to both the deployment sensor switch and the base tamper switch, and adapted to communicate with a remote alarm/monitoring system unit based on the inputs from the deployment sensor switch and base tamper switch. Alternatively to the wireless transmitter arrangement, the sensor switch or switches employed in the strap-type interface device may be hardwired to an alarm/monitoring system to provide an input to that system.

Another embodiment of an interface device within the scope of the present invention may be referred to as a "probe-type" interface device. In one form, a probe-type interface device is adapted for providing an interface to an object having a ferromagnetic component. This form of the probe-type interface includes an interface body, a first electrical contactor, and a second electrical contactor. Each of the electrical contactors is associated with a respective electrical lead which provides a connection point to an alarm/monitoring system. The first electrical contactor has an associated magnetic field to provide a magnetic attractive force to the ferromagnetic component. The first electrical contactor and the second electrical contactor are located on the interface body so that when the interface body is placed in an operating position with respect to the ferromagnetic component, the first electrical contactor and the second electrical contactor each contact a respective surface of the ferromagnetic component. This contact between the two electrical contactors and the ferromagnetic component forms a closed electrical circuit which may be used to provide a monitoring input to the alarm system.

In one application of a probe-type interface device according to the present invention, the interface device may be used with a wireless transmitter to receive the monitoring input and provide a wireless signal to a remote alarm/monitoring system. Alternatively, a probe-type interface device according to the present invention may have the two leads hard wired to provide a monitoring input to an alarm/monitoring system.

One embodiment of a probe-type interface device is particularly adapted to provide an interface to an object having a tubular ferromagnetic component. Firearms fall in this category of objects to be monitored in view of the ferromagnetic muzzle present in most firearms. A probe-type interface device specifically adapted for use in monitoring a firearm may include a first electrical contactor made up of a ring magnet. The second electrical contactor in this embodiment may include one or more tines that extend from the interface body in position to contact the inner surface of the firearm muzzle when the interface body is positioned so that the ring magnet makes contact with the end of the firearm muzzle. These contacts at the inner surface of the muzzle and at the end of the muzzle provide the desired closed electrical circuit which may provide a monitor input to a suitable alarm/monitoring system.

These and other advantages and features of the invention will be apparent from the following description of illustrative embodiments, considered along with the accompanying drawings.

DESCRIPTION OF ILLUSTRATIVE EMBODIMENTS

In this disclosure and the accompanying claims, terms such as "upper," "lower," "top," and "bottom" may be used to describe various surfaces and other features of devices embodying the present invention. It should be appreciated that these terms are used in the context of the orientation of structures shown in the accompanying drawings.

In the following description, the structure of an example strap-type interface device is described with reference to FIGS. 1-5, and certain alternate electronic components for a strap-type alarm interface device are described with reference to FIG. 6. An example probe-type alarm interface device according to the present invention is described with reference to FIGS. 7-11. A variation of the probe-type alarm interface device in which the device is integrated with a holster is described with reference to FIGS. 12-15. An additional alternate probe-type alarm interface device is described with reference to FIGS. 16-18.

Figure 1:
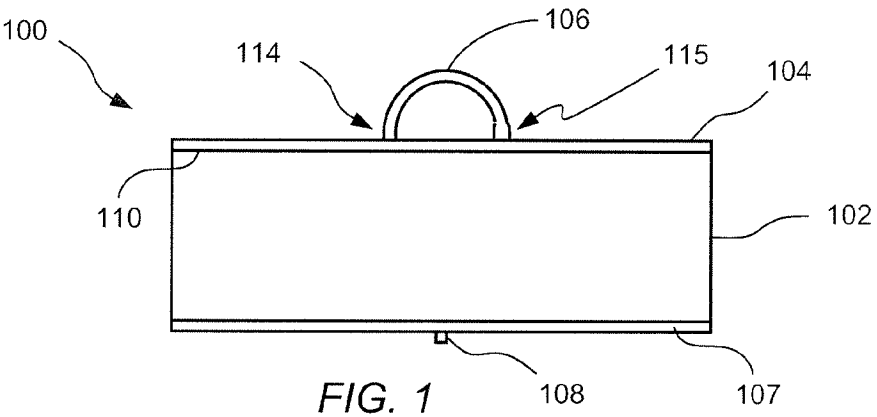
FIG. 1 is an end view of a strap-type interface device embodying one form of the present invention.

Referring now to FIG. 1, one preferred form of strap-type interface device 100 includes a base 102, a mounting pad 104, an elongated sensor strap 106, and a lower non-slip pad 107. FIG. 1 also shows a base tamper switch plunger 108 at a bottom of base 102.

Figure 2:
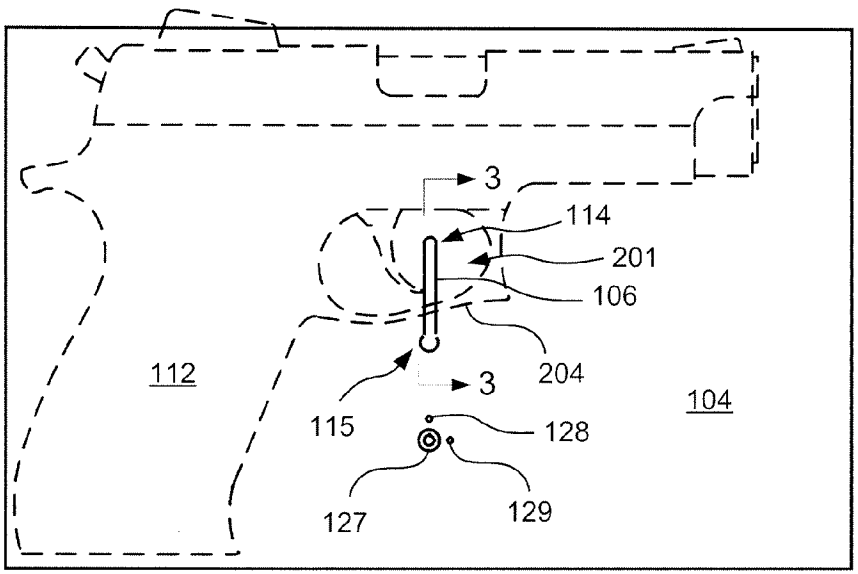
FIG. 2 is a top view of the interface device shown in FIG. 1, with a firearm shown in dashed lines resting on the interface device in a monitored position.

Mounting pad 104 is located on an upper surface 110 of base 102 and defines a surface on which a firearm or other object to be monitored may be placed. Upper support surface 110 is preferably rigid and provides a structural support surface for supporting the object to be monitored. FIG. 2 shows a firearm 112 in dashed lines resting in a monitored position on mounting pad 104. Mounting pad 104 is preferably made of a soft plastic or rubber material which provides a non-slip surface to help prevent an object placed on the pad from sliding relative to base 102. Lower non-slip pad 107 may include a similar soft plastic or rubber material which helps prevent base 102 from sliding relative to a surface on which device 100 rests.

Figure 3:
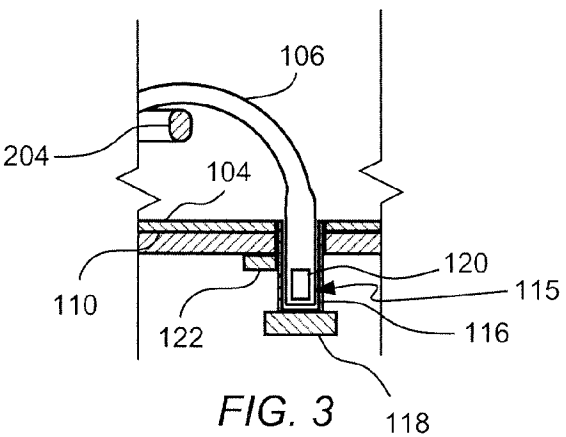
FIG. 3 is a partial section view showing the unsecured end of the sensor strap employed in the embodiment of FIG. 1, and showing the cooperation of the sensor strap unsecured end with the second sensor half.
Figure 4:
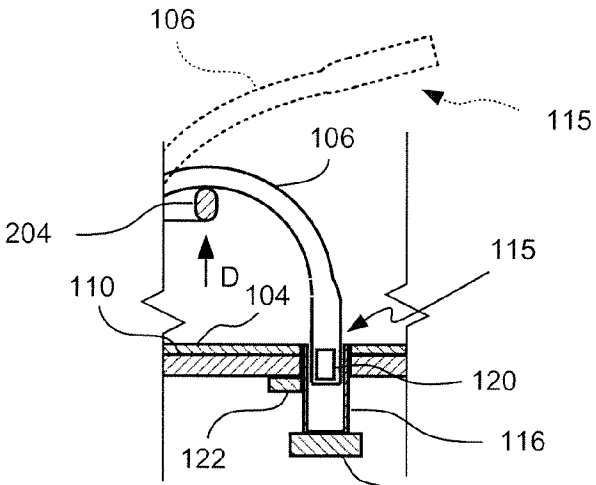
FIG. 4 is a partial section view similar to FIG. 3, but showing the sensor strap unsecured end removed from the second sensor half to break the sensor link.

Sensor strap 106 comprises a length of flexible tubular material having a secured end 114 which is immovably secured at the upper surface 110 of base 102. As best shown in FIGS. 3 and 4, sensor strap 106 also includes an unsecured end 115 which is adapted to be received in a receiver tube 116 which extends into base 102 from base upper surface 110. As indicated in FIG. 4, sensor strap 106 is sufficiently flexible and the fit between unsecured end 115 and receiver tube 116 is sufficiently loose to allow the unsecured end 115 to be freely removed from receiver tube 116 with very little if any resistance while the sensor strap secured end 114 remains firmly secured to base 102.

Referring still to FIGS. 3 and 4, a permanent magnet 118 is located at the bottom of receiver tube 116. Magnet 118 represents a reed activating magnet that cooperates with a magnetic reed switch 120 which is located in the unsecured end 115 of sensor strap 106. The magnetic reed switch 120 is enclosed in the sensor strap unsecured end 115 and thus shown only diagrammatically in FIG. 3 or 4. It will be appreciated that electrical connections are required for magnetic reed switch 120 mounted in sensor strap unsecured end 115. These electrical connections in this illustrated form of the alarm interface device include two insulated conductor wires extending through the strap 106 from secured end 114 to the magnetic reed switch. One of these conductor wires is connected to one terminal of the magnetic reed switch 120, while the other conductor wire is connected to the opposite terminal of the magnetic reed switch. Although these conductor wires are not shown in FIGS. 1-4, their presence will be appreciated from the electrical schematic diagram of FIG. 5 and the description of the operation of device 100 provided below.

In the form of the strap-type alarm interface device 100 illustrated in FIGS. 1-4, the sensor strap unsecured end 115 represents a first sensor half and receiver tube 116 represents a second sensor half When sensor strap unsecured end 115 is received in receiver tube 116 in the position shown in FIG. 3, the first and second sensor halves may be thought of as forming a sensor link with each other. When the first sensor half is moved sufficiently relative to the second sensor half that is, in this illustrated form of the invention, when unsecured end 115 is withdrawn sufficiently from the received position shown in FIG. 3, the sensor link is broken. As will be described further below in describing the operation of interface device 100, this breaking of the sensor link represents a transition that may be used to indicate that the firearm 112 has been removed from its monitored position on the interface device. In this particular embodiment shown in FIGS. 1-4, magnetic reed switch 120 represents a deployment sensor switch and comprises a normally open switch which is open when outside the influence of a magnetic field. However, when sensor strap unsecured end 115 is placed in the position shown in FIG. 3, the proximity of switch 120 (in unsecured end 115) to magnet 118 closes the switch. This closed position of magnetic reed switch 120 represents an armed state. When sensor strap unsecured end 115 (and thus switch 120 located therein) is withdrawn sufficiently from the position shown in FIG. 3, the switch 120 is no longer in operative proximity to magnet 118 and the magnetic field of the magnet is no longer strong enough to hold switch 120 closed. Thus switch 120 opens when sensor strap unsecured end 115 is removed sufficiently from receiver tube 116. This opening of switch 120 represents a break of the sensor link between sensor strap unsecured end 115 and receiver tube 116, and the open state of the switch represents an alarm state.

Interface device 100 further includes a magnetic tamper switch 122 to prevent magnetic reed switch 120 from being defeated with an external magnetic field. In this particular embodiment, magnetic tamper switch 122 is adapted to remain in a closed position (representing an "armed state") in the absence of a sufficiently intense magnetic field, but to transition to an open position (representing an "alarm state") when exposed to a sufficiently intense magnetic field. In the event a magnet is brought close to the opening of receiver tube 116 in a effort to keep magnetic reed switch 120 closed while withdrawing the sensor strap unsecured end 115 from the receiver tube, magnetic tamper switch 122 is sufficiently close to the opening of the receiver tube 116 so that the external magnetic field will also cause magnetic tamper switch 122 to change from the closed position (armed state) to the open position (alarm state). Although FIGS. 3 and 4 show magnetic tamper switch 122 immediately adjacent to receiver tube 116, the magnetic tamper switch need only be in an operative proximity to the opening of the receiver tube so that a magnet brought close to the opening of the receiver tube changes the state of the magnetic tamper switch.

Plunger 108 shown in FIG. 1 represents an actuator for a base tamper switch which is concealed within base 102 and thus not shown in FIG. 1. In its position protruding from a bottom surface 126 of base 102 and non-slip material 107, the spring biased plunger 108 is adapted to contact an external surface (not shown) on which device 100 is placed. The weight of device 100 overcomes the spring bias of plunger 108 and moves it to a retracted position. This retracted position represents an armed state for the base tamper switch (124 in FIG. 5), while the extended position shown in FIG. 1 represents an alarm state. As will be discussed further below in connection with the electrical schematic diagram of FIG. 5, the retracted plunger 108 places the base tamper switch 124 in a closed position. Extending plunger 108 to the extended position shown in FIG. 1 moves the base tamper switch 124 to an open position in the illustrated embodiment.

Interface device 100 further includes a key-operated bypass switch shown at 127 in FIG. 2, which allows a user of interface device 100 to use a key to alternatively place the device in an operating condition or an inactive condition. As will be discussed further below in connection with FIG. 5, the inactive condition bypasses magnetic reed switch 120, base tamper switch 124, and magnetic tamper switch 122, to allow the firearm or other object being monitored to be removed from the interface device 100 without producing a switch transition in any of switches 120, 122, and 124. Position indicators 128 and 129 associated with key-operated switch 127 provide a visual indication of the condition of device 100 as either in the operating condition or inactive condition.

Figure 5:
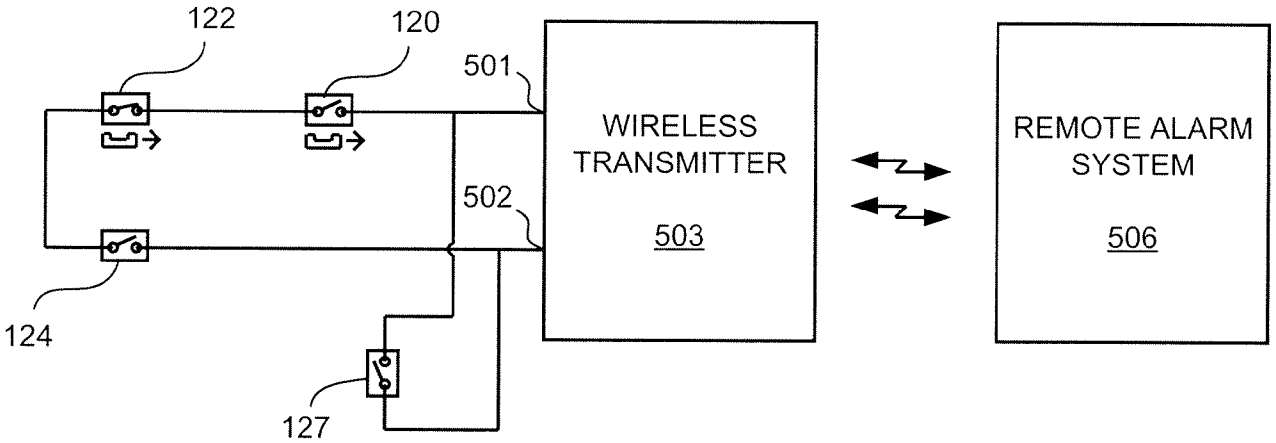
FIG. 5 is an electrical schematic of the strap-type interface device shown in FIG. 1, together with a wireless transmitter and an alarm system.

Referring now to the electrical schematic diagram of FIG. 5, magnetic reed switch 120, base tamper switch 124, and magnetic tamper switch 122 are connected in a common circuit in series between a first terminal 501 and a second terminal 502 of a wireless transmitter 503. Wireless transmitter 503 comprises a monitoring unit of an alarm/monitoring system and is adapted to communicate with a remote alarm/monitoring system 506. Key-operated switch 127 is connected to selectively shunt terminals 501 and 502 of wireless transmitter 503. It will be appreciated that base tamper switch 124, magnetic tamper switch 122, the electrical components of key-operated switch 127, wireless transmitter 503, and much of the connecting wires indicated in FIG. 5 are enclosed in base 102 and thus not readily accessible, save by opening base 102. Only the connecting wires to and from magnetic reed switch 120 and switch 120 itself are located outside base 102 (although still enclosed in strap 106).

The operation of interface device 100 to monitor a firearm 112 may now be described with reference to FIGS. 1-5. Interface device 100 is adapted to be placed, lower non-slip pad 107 down, on a suitable flat supporting surface such as the bottom of a nightstand or desk drawer. In this position, the weight of device 100 pushes base tamper switch plunger 108 upwardly to the retracted position to close base tamper switch 124 (placing the switch in its armed state). A firearm 112 may then be placed in a monitored position (the position shown in FIG. 2 for example) resting on pad 104 on top of base 102. In this monitored position, sensor strap 106 may be manipulated so as to extend up through the firearm trigger guard opening 201 and loop over the lower part of the trigger guard 204. Sensor strap unsecured end 115 may then be inserted into receiver tube 116 to the position shown best in FIG. 3 (and also shown by the position of sensor strap 106 in FIGS. 1 and 2) so that the sensor strap 106 forms a closed loop around the lower part of the firearm trigger guard 204. The proximity of magnet 108 to magnetic reed switch 120 in this position holds the normally open reed switch closed. However, the distance between magnet 108 and magnetic tamper switch 122 is such that the normally closed magnetic tamper switch remains closed. Thus, in the position shown in FIGS. 1-3, magnetic reed switch 120, magnetic tamper switch 122, and base tamper switch 124 are all closed so as to present a closed conductive circuit across terminals 501 and 502 of wireless transmitter 503. This closed circuit represents an input to wireless transmitter 503 and the remote alarm/monitoring system 506 with which the transmitter communicates. As long as key-operated bypass switch 127 remains in the open, operating position, if any one of switches 120, 122, or 124 opens, the closed circuit across terminals 501 and 502 is broken. The wireless transmitter 503 is capable of detecting this change to an open circuit across terminals 501 and 502 and is adapted to transmit a corresponding signal to remote alarm/monitoring system 506 for further action as will be described further below. With the key-operated bypass switch 127 in the open position and switches 122 and 124 both closed, if someone picks up firearm 112, the trigger guard part 204 will move upwardly in the direction indicated by arrow D in FIG. 4 and will eventually hit sensor strap 106 and pull unsecured end 115 upwardly out of receiver tube 116. Once the magnetic reed switch 120 is moved sufficiently far away from magnet 108, the switch will open to open the circuit across terminals 501 and 502. The position of sensor strap 106 and unsecured end 115 is an example of a position that may allow magnetic reed switch 120 to open to its alarm state. Alternatively, if the device 100 itself is lifted from its supporting surface, base tamper switch plunger 108 will extend to open base tamper switch 124 which would also open the circuit across terminals 501 and 502. Additionally, if a magnet is brought close to the top of receiver tube 116 in an effort to keep magnetic reed switch 120 closed while unsecured end 115 is removed from the receiver tube, the magnet will open magnetic tamper switch 122 to open the circuit across terminals 501 and 502.

It will be noted particularly from comparing the position of sensor strap 106 in FIG. 3 and the strap position shown in FIG. 4 that preferably not all movement of the strap from the position shown in FIG. 3 will cause magnetic reed switch 120 to open to produce an alarm signal input detectable by wireless transmitter 503. The difference between the fully inserted position of sensor strap unsecured end 115 shown in FIG. 3 and the withdrawn position in which switch 120 changes state as shown in FIG. 4 may be referred to as operational tolerance. This operational tolerance represents the distance the sensor strap unsecured end 115 may be withdrawn from the fully inserted position before an alarm signal input is provided to wireless transmitter 503. Although the preferred operational tolerance will depend upon the particular application of interface device 100, the operational tolerance may typically be as little as one-sixteenth of an inch but generally no greater than approximately one-half inch. The invention is not limited to any particular operational tolerance. Some forms of the invention may be designed so that the operational tolerance is essentially zero such that any movement of the sensor strap unsecured end 115 from the position shown in FIG. 3 will cause switch 120 to change state.

It should be noted that the sensor strap unsecured end 115 shown in FIGS. 1-4 has a somewhat larger diameter than the middle part of sensor strap 106 in order to accommodate magnetic reed switch 120. In order to prevent any catching on the trigger guard 204 as the firearm is removed from the monitored position, sensor strap 106 has a smooth or tapered transition from unsecured end 115 to the adjacent portion of sensor strap 106.

Since the circuit shown in FIG. 5 provides a normally closed circuit as an input to wireless transmitter 503, it is possible to circumvent the operation of the circuit by providing a short between terminals 501 and 502 or shorting around the individual switches 120, 122, and 124. Simply shorting terminals 501 and 502, and shorting around switches 122 and 124 does not pose a significant security risk since these components are all safely enclosed in base 102 and it would be difficult to break in to the base to tamper with the circuit. Additionally, there are a number of different strategies for addressing the possibility of shorting the wires extending through strap 106 to and from magnetic reed switch 120. One strategy is to use a robust material for the tubular material making up the sensor strap 106 to make it difficult to gain access to the wires inside the strap. Another strategy is to modify the circuit shown in FIG. 5 to add a known resistance in the circuit. This type of resistance in a sensor circuit is commonly known as an end-of-line resistance and requires that the monitoring circuit (in this case wireless transmitter 503) be capable of monitoring for the known resistance and to detect a change in resistance in the circuit (across terminals 501 and 502 in the case of FIG. 5). An appropriate location for an end-of-line resistor in device 100 is adjacent to magnetic reed switch 120 at the sensor strap unsecured end 115. This position places the end-of-line resistor in the receiver tube 116 when device 100 is operational to monitor an object resting on the device.

The scope of the present inventions encompasses numerous variations in interface device 100 shown in FIGS. 1-5. For example, although interface device 100 is particularly adapted for use in monitoring a firearm, especially a pistol, the base of the device, and sensor strap may be sized to accommodate other types of objects to be monitored. Also, although the trigger guard part 204 is used in the above example as a feature over which sensor strap 106 is positioned to make a sensor link, any suitable feature of the firearm or other object being monitored may be used. Even where the sensor strap 106 extends through the trigger guard opening, device 100 may alternatively be adapted so that the sensor strap extends in the opposite direction from that shown best in FIG. 2 so as to extend over the breach or barrel of the firearm. This alternative would require a repositioning of the strap secured end 114 from the position shown in FIGS. 1 and 2 so that receiver tube 116 could be positioned appropriately, and would also probably require that device 100 have a somewhat larger upper surface area. Also, although the illustrated interface device 100 shows receiver tube 116 extending at a right angle to the top surface 110, a receiver tube 116 according to the invention may extend at an angle to surface 110 to facilitate smooth removal of the firearm 112.

The invention is also not limited to the particular circuit arrangement shown in FIG. 5. That is, the circuit may include just a deployment sensor switch (represented by magnetic reed switch 120 in example device 100), or additional switches such as switches 122 and 124 in device 100, and the circuit may be adapted to provide a normally closed circuit across terminals 501 and 502, a normally open circuit, or a circuit having some other known characteristic which transmitter 503 is adapted to detect. It is possible for each switch 120, 122, and 124 to be connected to respective terminals of a wireless transmitter to provide individual signals. Also, any number of switch types may be employed to provide the desired input across terminals 501 and 502. The invention is also not limited to purely electronic switches, but may employ optical devices as well to provide the desired input across terminals 501 and 502. For example, a deployment sensor switch within the scope of the present invention may rely on an optical signal detected through the sensor link between the sensor strap unsecured end 115 and receiver tube 116. It will be appreciated also that numerous bypass devices may be used instead of key-operated switch 127. For example, a bypass switch providing the bypass function of switch 127 in FIG. 5 may be controlled via a keypad mounted on device 100, a biometric device such as a fingerprint scanner for example, or by any other suitable security device or arrangement.

Interface device 100 may cooperate with numerous alternative types of alarm/monitoring systems within the scope of the present invention. In a preferred embodiment of the present invention, the remote alarm/monitoring system (506 in FIG. 5) is a home or office security system which is capable of receiving other monitoring inputs such as inputs from a door sensor, window sensor, motion sensor, or any other type of sensor device. However, it is also possible that the remote alarm/monitoring system may be a security system for an armory, a government building, a police or military vehicle, or any other location. Also, the remote alarm/monitoring system (such as 506 in FIG. 5) may itself be monitored by a central monitoring station, which may be, for example, a home security company monitoring station, a police station, a fire station, or an emergency/911 dispatch station. It is also possible within the scope of the present invention that interface device 100 directly transmits an alarm input to emergency personnel at a central monitoring station without first interfacing with a remote alarm/monitoring system such as system 506 in FIG. 5. The present invention is also not limited by how a remote alarm/monitoring system (such as system 506 in FIG. 5) reacts to an alarm signal transmitted from wireless transmitter 503. The alarm/monitoring system 506 may or may not send an alarm signal to a central monitoring station, and may or may not produce a local audible alarm. In some applications, the alarm/monitoring system which receives a signal based on an input from device 100 is simply a monitoring system which does not produce any alarm per se, but simply tracks the state of device 100. Also, the present invention is not limited to the wireless connection to the remote alarm/monitoring system shown for example in FIG. 5. Rather than the connection through wireless transmitter 503 (which is preferably a battery operated device located within base 102), terminals 501 and 502 may be terminals of the remote alarm/monitoring system itself and the electronics within base 102 may be hardwired to those terminals.

Figure 6:
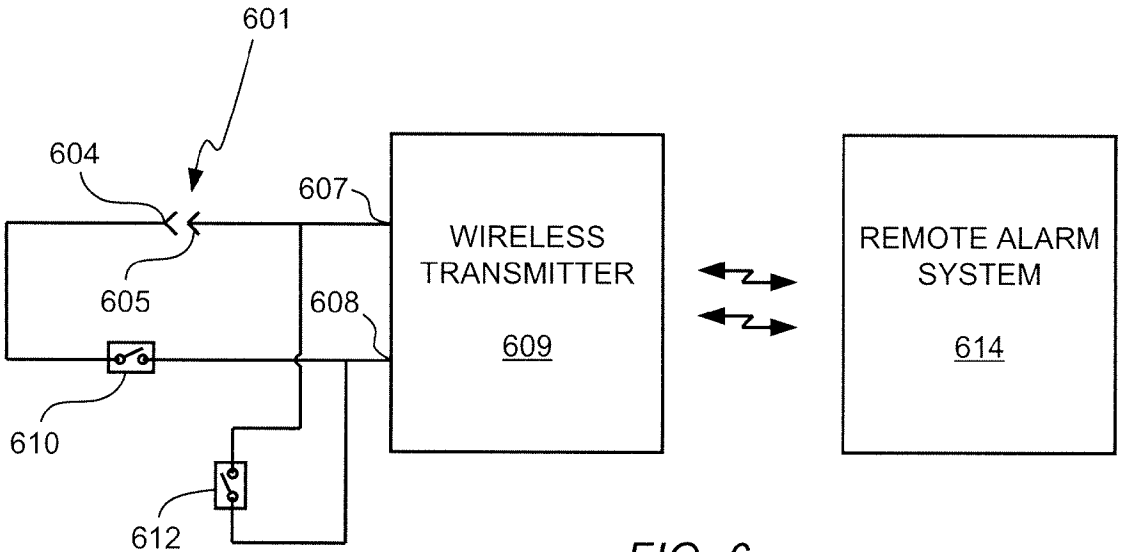
FIG. 6 is an electrical schematic of a second strap-type interface device within the scope of the present invention, shown with a wireless transmitter and an alarm system.

FIG. 6 shows an alternate electronic circuit that may be used in the interface device 100 shown in FIGS. 1-4. This alternate circuit employs an electrical connector or plug arrangement 601 to replace the magnetic reed switch 120 shown in FIG. 5. In this alternate embodiment, one half 604 of a male/female plug represents a first sensor half and is located at the sensor strap unsecured end 115. The other half 605 of plug arrangement 601 represents the second sensor half and is located on base 102 in the place of receiver tube 116 shown in FIGS. 3 and 4. The sensor link is formed by making a connection between the two plug halves 604 and 605. Once the connection between the two plug halves 604 and 605 is made, moving the strap 106 as indicated in FIG. 4 separates the two plug haves and breaks the electrical connection (sensor link) to produce an open circuit across terminals 607 and 608 of wireless transmitter 609. Plug arrangement 601 is preferably adapted so that there is minimal frictional resistance between the two plug halves 604 and 605 so as to pose minimal resistance to deployment of firearm 112. It will be noted that in this form of the invention the plug arrangement 601 represents the deployment switch. Unlike the arrangement shown in FIG. 5, part of the deployment switch is included in the sensor strap unsecured end 115 and part of the deployment switch is included on base 102.

FIG. 6 assumes that a single conductor is connected to plug half 604 and a single conductor is connected to plug half 605. The conductor connected to plug half 604 would run through strap 106, whereas the conductor for plug half 605 would run inside base 102. A suitable plug arrangement 601 in this case could comprise any arrangement that produces a reasonably stable electrical connection between the two plug halves. One preferred arrangement includes a conductive magnet forming one plug half and an oppositely poled magnet or simply a ferromagnetic material as the other plug half. In this case the two plug halves make the desired electrical connection by the magnetic attraction between the two plug halves and no frictional engagement between the two plug halves is necessary. An alternative arrangement may employ a mono audio plug for plug arrangement 601. In this case the conductors may be connected to the two plug halves as described for the previous example. Alternatively, two conductors may run through strap 106 with each connected to a different pole of the mono audio plug half, and the plug half mounted on base 102 could have its two terminals shorted or connected across an end-of-line resistor to form a supervised circuit. Numerous other plug arrangements may be used as plug arrangement 601 to provide the desired closed circuit when the two plug halves are brought together.

The alternate circuit shown in FIG. 6 includes a base tamper switch 610 which functions similarly to switch 124 shown in FIG. 5. The alternate circuit also includes a key-operated switch 612 which corresponds to key-operated switch 127 in FIG. 6. Wireless transmitter 609 cooperates with a remote alarm/monitoring system 614 in the same manner that wireless transmitter 503 in FIG. 5 cooperates with remote alarm/monitoring system 506. However, it will be noted that the alternate circuit shown in FIG. 6 does not require a magnetic tamper switch similar to switch 122 in FIG. 5, since plug arrangement 601 is not susceptible to magnetic interference.

It should be noted that the example circuits described above indicate that the circuit containing the various switches is directly connected to the terminals of the wireless transmitter. However, interface devices within the scope of the present invention may use the circuit having the switches (e.g. the circuit including switches 120, 122, and 124 in FIG. 5) to indirectly provide an input signal to the respective wireless transmitter or alarm system. For example, a component of the interface device may directly receive the signal provided by the switch circuit, and convert that signal to a standard signal which is then applied directly to the terminals of the wireless transmitter or alarm system. For a further example, the circuit shown in FIG. 5 may provide a signal to an intermediate component rather than wireless transmitter 503 and the intermediate component may provide a signal in a form suitable for use by wireless transmitter 503 (e.g. a digital signal or an open circuit/closed circuit signal).

Figure 9:
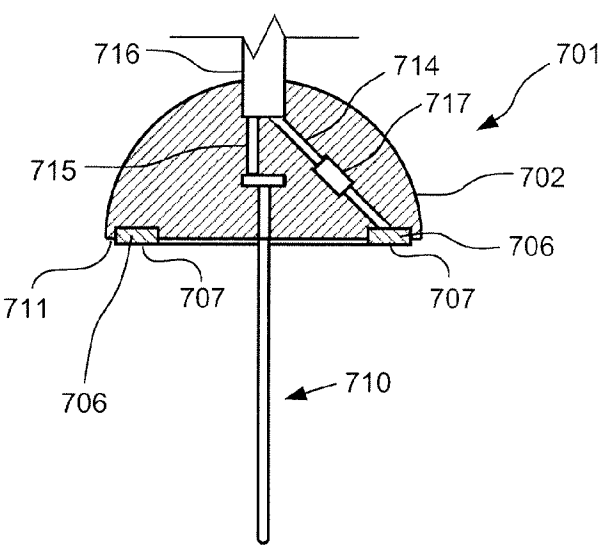
FIG. 9 is a longitudinal partial section view taken along line 9-9 in FIG. 8.
Figure 7:
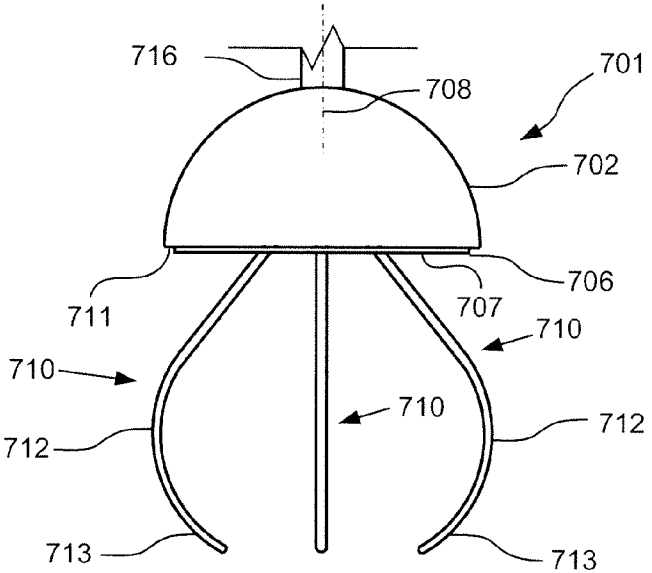
FIG. 7 is a side view of a probe-type interface device embodying another form of the present invention.
Figure 8:
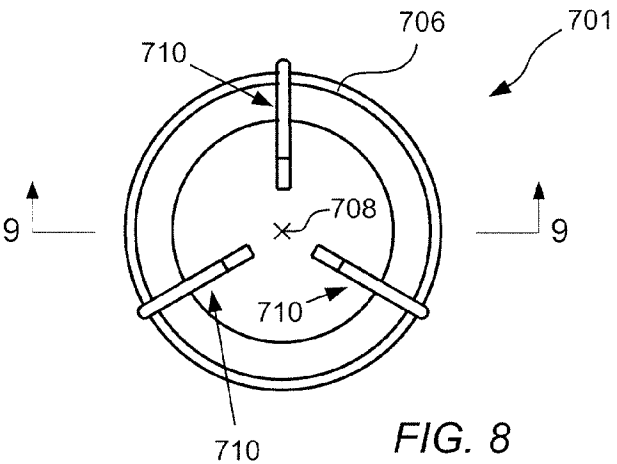
FIG. 8 is an end view of the interface device shown in FIG. 7.
Figure 10:
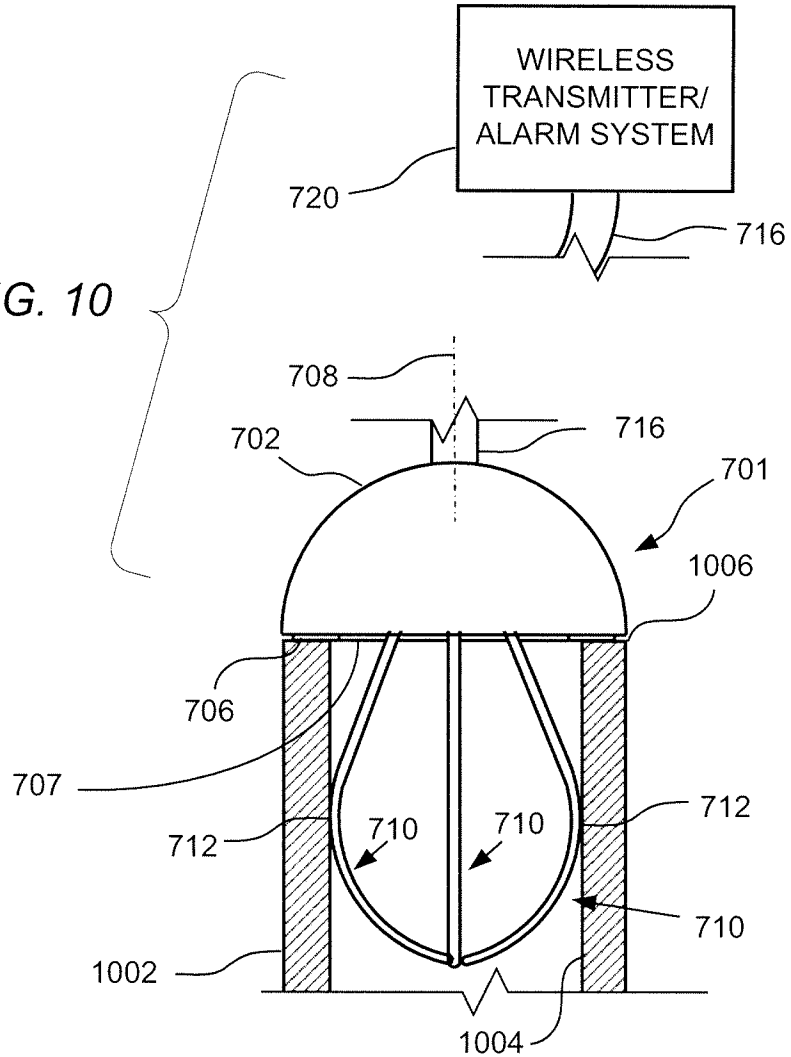
FIG. 10 is a side view of the interface device similar to FIG. 7, but with the interface device in an operating position on a firearm muzzle shown in section, and with a wireless transmitter/alarm system connected to the interface device.
Figure 13:
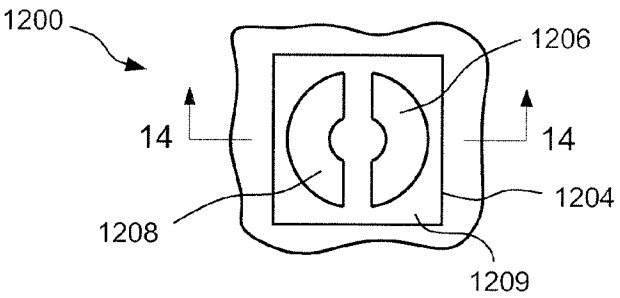
FIG. 13 is a top plan view of a portion of the bottom surface inside the holster shown in FIG. 12.
Figure 14:
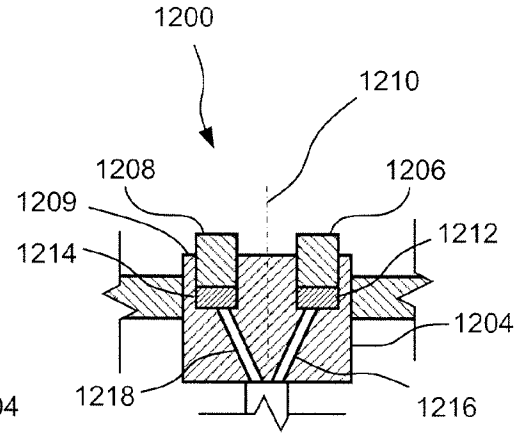
FIG. 14 is a partial section view along line 14-14 in FIG. 13.
Figure 12:
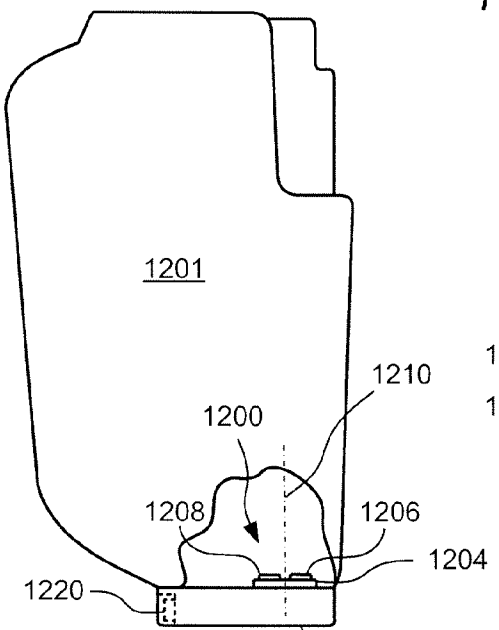
FIG. 12 is a partially cut away side view of a firearm holster having an integrated alarm/monitoring system interface device.
Figure 15:
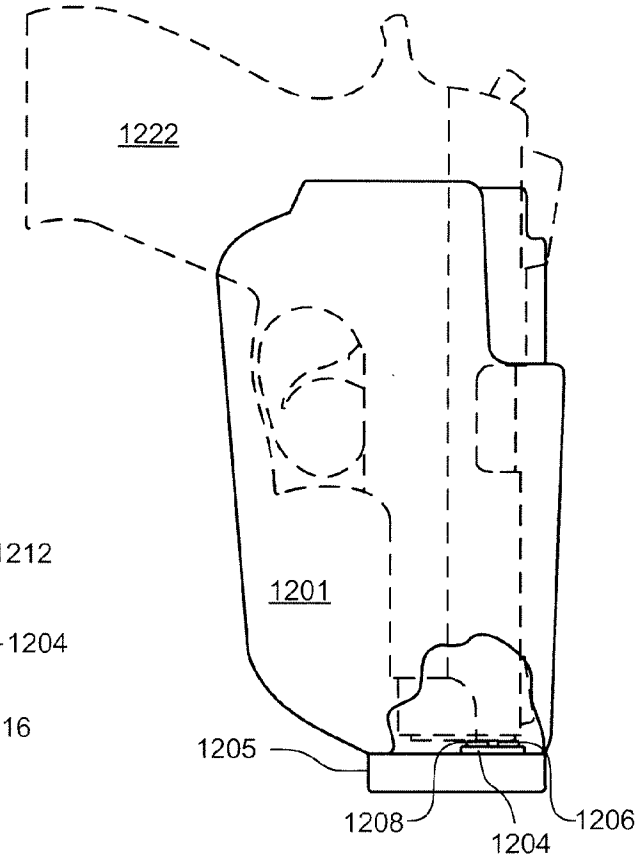
FIG. 15 is a partially cut away side view similar to FIG. 12 but showing a pistol in a holstered position engaged by the alarm interface device.

Referring now to FIGS. 7-11, a probe-type interface device 701 embodying an alternate form of the present invention is particularly adapted to monitor objects having a tubular opening formed from a ferromagnetic material. Firearms fall into this category of objects in view of the firearm muzzle which is typically made from a ferromagnetic material. Interface device 701 includes an interface body 702 comprising a non-conductive housing, and also includes an electrically conductive magnetic ring 706 that is substantially centered on a central axis 708 of the device. Magnetic ring 706, which represents an electrical contact in this embodiment, has an outwardly facing ring face 707 which is proximate to a face 711 of interface body 702. Interface device 701 also includes a number of tines 710 extending from the face 711 of interface body 702. Tines 710 are made of an electrically conductive material and each represent another electrical contact in this embodiment. The illustrated tines 710 are arranged in a radially symmetrical pattern about central axis 708, and are adapted to flex between a relaxed state shown best in FIG. 7 and a compressed state. An example of a compressed state for tines 710 is shown in FIG. 10. Tines 710 are spring-biased to remain in the relaxed state in the absence of an external force. Each tine 710 has a flared part 712 that flares outwardly with respect to central axis 708. Each tine 710 also includes a deflecting part 713 at the distal end thereof. This deflecting part 713 of each tine extends radially inwardly back toward central axis 708.

As shown in the section view of FIG. 9, magnetic ring 706 is electrically coupled to a first lead 714 and each tine 710 is electrically coupled to a second lead 715. Leads 714 and 715 extend to interface body 702 through a suitable protective tether 716 which is firmly secured to the interface body. FIG. 9 also shows an end-of-line resistor connected in first lead 714 within interface body 702. When interface device 701 is operational to provide an input signal for an alarm system, the opposite end of tether 716 extends to a wireless transmitter or alarm system such as that shown at 720 in FIG. 10, with leads 714 and 715 connected to the input terminals to the wireless transmitter or alarm system. These input terminals 721 and 722 are shown in the electrical schematic diagram of FIG. 11.

FIG. 10 shows interface body 702 in an operating position on an object 1002 to be monitored, which may be the muzzle of a firearm for example. In the operating position on object 1002, tines 710 extend into the object so as to contact an inner surface 1004 of the object. Also, the face 707 of magnet 706 makes contact with an end surface 1006 of object 1002. Because tines 710 are electrically connected to lead 715 and magnet 706 is electrically connected to lead 714, the contact between tines 710 and ferromagnetic object 1002 and between magnet 706 and the object has the effect of shorting the two leads so that a closed circuit having the resistance of end-of-line resistor 717 appears across terminals 721 and 722 shown in FIG. 11. However, if interface body 702 is removed from the operating position shown in FIG. 10 sufficiently to break the electrical contact between magnet face 707 and end surface 1006 of object 1002, the circuit between leads 714 and 715 will be broken and present an open circuit across terminals 721 and 722. This transition to an open circuit may be detected by wireless transmitter/alarm system 720 and used to trigger an appropriate response, either a local or remote audible alarm, a local or remote notification, or any other suitable action. Also, should leads 714 and 715 be shorted in some fashion along the length of tether 716, the transition from the known resistance of end-of-line resistor 717 to a short circuit may also be detected by wireless transmitter/alarm system 720 and used to trigger an appropriate response.

It will be noted that the structure of interface device 701 helps ensure interface body 702 is retained securely in the operating position and also facilitates positioning the interface body in the operating position. For example, the inwardly angled deflecting part 713 of each tine 710 contacts the end of object 1002 as the tines are inserted into the open end of object 1002. This contact at angled deflecting part 713 of each tine 710 helps smoothly flex the tines inwardly to the compressed position to allow the tines to be inserted and the interface body 702 moved to the operating position. The mechanical bias of tines 710 in the compressed position helps ensure good electrical contact between the tines and object inner surface 1004. Also, the magnetic force exerted by magnet 706 on object 1002 not only helps pull the magnet surface 707 into good electrical contact with object end surface 1006 but also helps hold interface body 702 in the operating position shown in FIG. 10.

Figure 11:
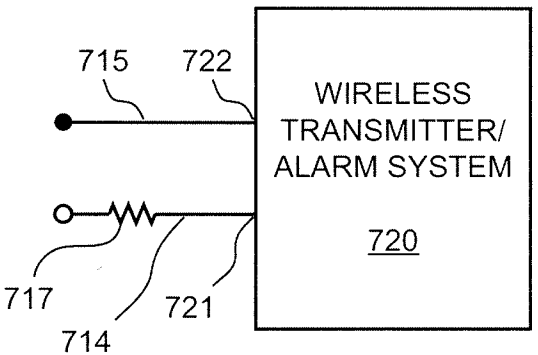
FIG. 11 is an electrical schematic diagram of a probe-type interface device such as that shown in FIG. 7-10, together with a wireless transmitter/alarm system.

Because probe-type interface device 701 employs the body of the object being monitored for closing the circuit between leads 714 and 715, no additional switches are required in device 701. Thus the electrical schematic diagram of FIG. 11 shows simply leads 714 and 715 connected directly as inputs to terminals 721 and 722. Of course, it is desirable to be able to disable interface device 701 so that it may be removed from the operating position by an authorized user without prompting an alarm response by the alarm system (or perhaps only a monitoring system) to which the interface device provides an input. Thus, some forms of the interface device may include a key-operated switch (not shown) connected similarly to switch 127 shown in FIGS. 1 and 5 for allowing the circuit between leads 714 and 715 to be closed across an appropriate resistance while interface body 702 is removed from an operating position. Alternatively, wireless transmitter/alarm system 720 may be placed in a condition in which it ignores a transition away from the known resistance across terminals 721 and 722, or otherwise fails to produce the full alarm or monitoring response to such a transition to an open circuit across the terminals. For example, an alarm system with which interface device 701 is used may be controlled through computer software and a user interface provided through the software may allow a user to place the alarm system in a condition in which no alarm response is generated upon a transition from the known resistance of resistor 717 across terminals 721 and 722.

Numerous variations of probe-type interface device 701 are possible within the scope of the present invention. For example, although interface body 702 is illustrated as a one piece solid object made of a nonconductive material, an interface body within the scope of the present invention may be made of two of more pieces connected in a suitable fashion. In any event, a suitable interface body and/or separate electrical insulation will maintain electrical isolation between leads 714 and 715 and between magnet 706 and tines 710 (aside from the closed circuit condition when the device is in the operating position shown in FIG. 10). Also, it will be appreciated that leads 714 and 715 must remain electrically isolated from each other in tether 716 and will thus include appropriate insulation along the length of the tether.

Other variations on device 701 relate to the nature and structure of tines 710. Specifically, although it is convenient for tines 710 to be formed from exposed lengths of spring steel, the conductive material need not be exposed along the entire length of each tine. It is only necessary in this inside contact type of device that at least one tine includes a conductive surface exposed to make electrical contact with the object being monitored when the interface device is in the operating position. More or fewer tines may be used, although preferably at least two opposing tines are used in this "inside contact" probe-type device, to provide a centering effect and help ensure good electrical contact with the inner surface of the object being monitored.

It should also be noted that an end-of-line resistor such as resistor 717 may not be used in some forms of a probe-type interface device according to the present invention. In these forms, the device may use a closed circuit to indicate a proper connection with the object being monitored and a transition to an open circuit to indicate the device has been removed from the operating position on the object.

Referring now to FIGS. 12-15, a probe-type interface device 1200 within the scope of the present invention is shown integrated into a firearm holster 1201. Interface device 1200 according to this embodiment includes a non-electrically conductive interface body 1204 which is mounted in a housing 1205 molded or otherwise attached at the bottom of holster 1201. A first semicircular magnet 1206 and a second semicircular magnet 1208 are mounted on interface body 1204 so that a distal surface of each magnet protrudes slightly from a face 1209 of the interface body. Both magnets 1206 and 1208 are electrically conductive. Also, each magnet 1206 and 1208 is preferably mounted on interface body 1204 so as to allow a limited amount of movement along an axis shown by reference numeral 1210. A biasing device 1212 acts on magnet 1206 and a biasing device 1214 acts on magnet 1208 to bias the respective magnet upwardly in the orientation of FIGS. 12 and 14. Suitable retainer devices (not shown) may be included to hold magnets 1206 and 1208 on interface body 1204 against the mechanical biasing force provided by biasing devices 1212 and 1214. Biasing devices 1212 and 1214 may include conductive leaf or coil springs to facilitate electrical coupling between the respective magnet and a respective lead which extends into interface body 1204. In particular, lead 1216 is electrically connected to magnet 1206 preferably through biasing device 1212 and lead 1218 is electrically connected to magnet 1208 preferably through biasing device 1214. Each lead 1216 and 1218 is connected to a respective terminal of a wireless transmitter which is housed within housing 1205. Although the battery-powered wireless transmitter itself is not shown in FIGS. 12-15, it will be appreciated that the connection may be as shown in the embodiment of FIG. 11 as described above, either with or without an end-of-line resistor connected in the circuit. Housing 1205 preferably includes a recessed switch 1220 which is operatively connected to the wireless transmitter in the housing to facilitate turning off or otherwise disabling the transmitter as desired by the user.

Interface device 1200 functions similarly to interface device 701 described above. However, rather than making contact with the object being monitored in the inside surface of the tubular object, each magnet 1206 and 1208 makes contact at a different location on an end of the object to be monitored, in this case, a firearm 1222 that may be placed in holster 1201. When firearm 1222 is fully inserted to the holstered position shown in FIG. 15, each magnet 1206 and 1208 contacts a surface of the firearm, in this case, different areas of the end of the firearm muzzle. The contact between the respective magnets 1206 and 1208 and the ferromagnetic firearm muzzle completes the electrical circuit between leads 1216 and 1218 so that the interface device 1200 presents a closed circuit across the terminals of the wireless transmitter housed in housing 1205 (with or without a known resistance). However, when firearm 1222 is withdrawn from the holstered position shown in FIG. 15, that is, withdrawn beyond the limit of movement of magnets 1206 and 1208 along axis 1210, the magnets eventually break contact with the firearm muzzle to open the circuit between leads 1216 and 1218. This transition from a closed to open circuit across leads 1216 and 1218 and the corresponding terminals of the wireless transmitter represents a signal which may be detected by the wireless transmitter and used as a basis for transmitting an alarm signal to a remote alarm or monitoring system.

The holster integrated interface device 1200 and wireless transmitter may be used to initiate a signal when a law enforcement officer deploys their firearm. The wireless transmitter may be adapted to send a deployment signal to the law enforcement officer's vehicle for relay to a law enforcement agency dispatching or monitoring center. Alternatively, the wireless transmitter associated with device 1200 may be adapted to transmit a deployment signal directly to a law enforcement agency dispatching or monitoring center. This automatic deployment signal obviates the need for the law enforcement officer to manually transmit a report that they have deployed their weapon.

It will be appreciated that the split-ring magnet probe arrangement shown in FIGS. 12-15 is only shown as an example of a probe-type interface incorporated into a holster. As another example, a probe-type interface device such as that shown in FIGS. 7-11, that is, an inside contact type interface device may be incorporated into a holster. In this arrangement the tines (such as tines 710) would be located such that they extend into the firearm muzzle as the firearm is holstered, and another contactor (such as ring magnet 706) is located in the holster to make contact with the end of the firearm muzzle when the firearm is in the fully holstered position. It should also be appreciated that a holster need not have a separate housing such as housing 1205, but may simply include an extension area large enough to accommodate the probe-type device and associated electronics, including a battery powered wireless transmitter.

Figure 16:
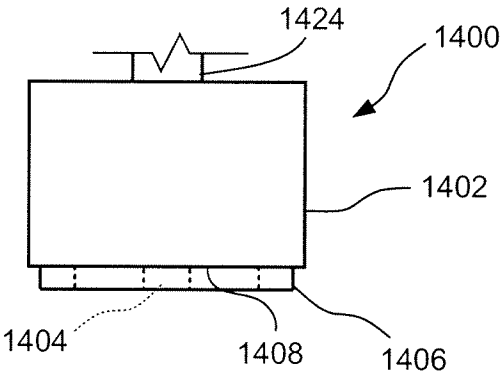
FIG. 16 is a side view of an alternate probe-type interface device embodying principles of the present invention.
Figure 17:
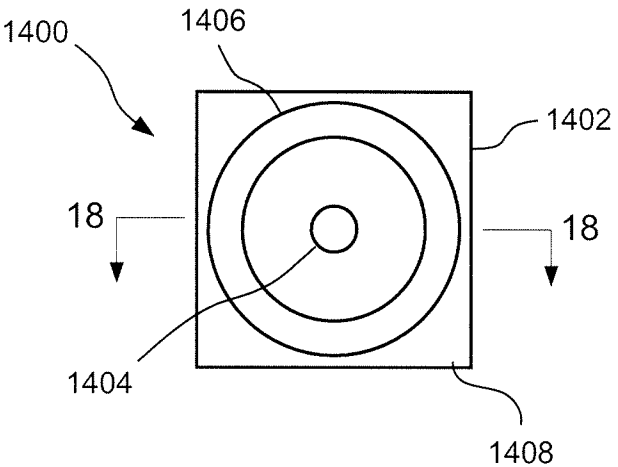
FIG. 17 is a bottom plan view of the probe-type interface device shown in FIG. 17.
Figure 18:
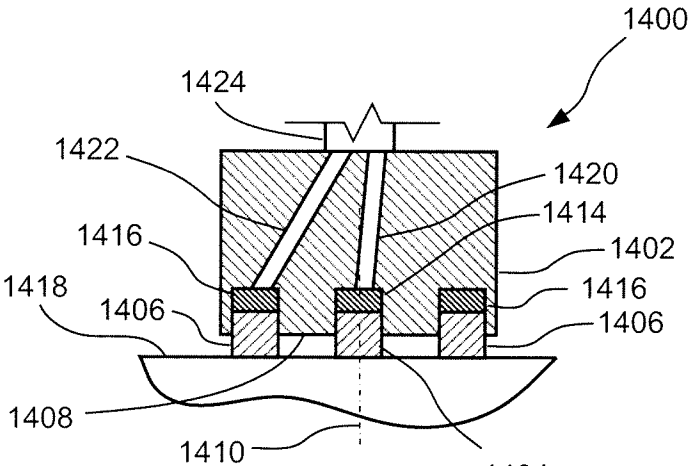
FIG. 18 is a partial section view taken along line 18-18 in FIG. 17, and also showing a surface with which the interface device is engaged.

FIGS. 16-18 show another alternate form of probe-type interface device 1400 embodying principles of the present invention. This particular embodiment is adapted for monitoring an object that includes a ferromagnetic component with a generally flat surface. Interface device 1400 includes an interface body 1402 which provides a non-conductive housing for a first magnet 1404 and an electrical contactor 1406 which also preferably comprises a magnet. Magnets 1404 and 1406 are each mounted on interface body 1402 so that a distal end of the respective magnet protrudes somewhat from a face 1408 of the interface body. Similarly to the embodiment shown in FIG. 14, each magnet 1404 and 1406 is preferably mounted on interface body 1402 so as to allow a certain range of movement along an axis 1410 shown in FIG. 18. Each magnet is also preferably associated with a respective biasing device 1414 and 1416 to bias the respective magnet outwardly from interface body 1402 and provide electrical contact between the respective magnet and a conductive lead of the device. In particular, referring to the section view of FIG. 18, magnet 1404 is electrically connected to a lead 1420 while magnet 1406 is electrically connected to a separate lead 1422. These leads extend through a tether 1424 connected to interface body 1402 and may be connected at their opposite end to a respective terminal of a wireless transmitter for an alarm/monitoring system or a hardwired terminal to an alarm/monitoring system similarly to the arrangement between device 701 and alarm system 720 shown in FIG. 10.

When interface body 1402 is placed in the operating position with respect to a relatively flat surface 1428 of a ferromagnetic object to be monitored or a ferromagnetic component of an object to be monitored, each magnet 1404 and 1406 makes electrical contact with the surface 1428 at different locations to form a closed electrical circuit across the magnets, the leads 1420 and 1422, and across alarm system terminals to which the leads may be connected. However, when interface body 1402 is removed from contact with surface 1428, the magnets 1404 and 1406 break contact with the surface to produce an open circuit across the magnets, leads 1420 and 1422, and alarm system terminals. As with the other embodiments described above, the transition from the closed circuit to the open circuit condition represents an input to the alarm system which may be used to initiate an alarm reaction suitable for the particular application of the interface device. Of course, an end-of-line resistor may be included in interface device 1400 so that the alarm system used with the device would have to be capable of detecting a change from the known resistance of the resistor to either a short circuit or an open circuit.

It should be noted that ferromagnetic surface 1428 may be a surface of any type of object.

Consequently, interface device 1400 is suitable for monitoring a wide variety of metal objects and objects having metal components.

It also should be noted that the positional relationship among first magnet 1404 and second magnet 1406 is not limited to the arrangement shown in the illustrative embodiment of FIGS. 16-18. Any arrangement in which first magnet 1404 and second magnet 1406 may contact a respective surface of a ferromagnetic object falls within the scope of the present invention. For example, the ferromagnetic object may be a flat sheet of metal, with first and second magnets each contacting an opposing face of the sheet of metal.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. An alarm or monitoring system interface for firearms, the alarm or monitoring system interface including:

(a) a base which provides a support surface on which a firearm to be monitored rests when the firearm is in a monitored position, the support surface defining a lifting direction in which the firearm in the monitored position must be lifted to lift the firearm from the monitored position;

(b) an elongated sensor strap having a secured end and an elongated unsecured end opposite to the secured end, the elongated unsecured end of the sensor strap comprising a first sensor half and the secured end of the sensor strap being secured to the base;

(c) a second sensor half mounted on the base and spaced apart from the secured end of the sensor strap to removeably receive the first sensor half in a received position to form a sensor link with the first sensor half, the elongated unsecured end of the sensor strap which comprises the first sensor half extending in the lifting direction when the sensor link is formed between the first sensor half and the second sensor half;

(d) a deployment sensor switch adapted to reside in an armed state when the first sensor half and second sensor half form the sensor link, and to move to an alarm state when the first sensor half is moved with respect to the second sensor half so as to break the sensor link, the deployment sensor switch including an alarm/monitoring system connection for providing an input for an alarm/monitoring system; and (e) wherein the elongated sensor strap has a length sufficient to form a closed loop around a portion of the firearm resting on the support surface of the base in the monitored position with the first sensor half in the received position to form the sensor link with the second sensor half, so that a triggering movement of the firearm in the lifting direction from the monitored position resting on the support surface of the base produces contact between a portion of the firearm and the sensor strap and causes the first sensor half to move from the received position beyond an operational tolerance with respect to the second sensor half so as to break the sensor link between the first sensor half and second sensor half.

2. The apparatus of claim 1 further including a base tamper switch located at a bottom surface of the base opposite to the support surface, the base tamper switch adapted to reside in an armed position when the base rests with its bottom surface facing an external surface and to reside in an alarm state when the base bottom surface is separated from the external surface beyond a predefined distance.

3. The apparatus of claim 2 wherein the deployment sensor switch and the base tamper switch are connected in a common circuit to provide a single signal at the alarm system connection.

4. The apparatus of claim 1 wherein the deployment sensor switch is a normally open magnetic reed switch, wherein a reed activating magnet is included with the second sensor half, and wherein the sensor link is formed when the normally open magnetic reed switch comprising the deployment sensor switch is brought into operative proximity to the reed activating magnet.

5. The apparatus of claim 4 wherein the second sensor half includes a receptacle having an opening in the base support surface, and wherein the apparatus further includes a magnetic tamper switch located in operative proximity to the opening of the receptacle in the base support surface.

6. The apparatus of claim 5 further including a base tamper switch located at a bottom surface of the base opposite to the support surface, the base tamper switch adapted to reside in an armed position when the base rests with its bottom surface facing an external surface and to reside in an alarm state when the base bottom surface is separated from the external surface beyond a predefined distance, and wherein the deployment sensor switch, the base tamper switch, and the magnetic tamper switch are all connected in a common circuit to provide a single signal at the alarm system connection.

7. The apparatus of claim 6 further including a key-operated bypass switch connected in the common circuit in position to bypass the deployment sensor switch, base tamper switch, and magnetic tamper switch.

8. The apparatus of claim 1 further including a monitoring device having input terminals operatively connected to the deployment sensor switch, the monitoring device adapted to produce a monitoring signal on a transition from a first electrical condition across the deployment sensor switch to a second electrical condition.

9. The apparatus of claim 1 wherein the deployment sensor switch is mounted at the unsecured end of the sensor strap and comprises a normally open switch connected across two conductors extending through the sensor strap, and wherein a resistor is connected in one of the conductors adjacent to the deployment sensor switch.

10. An alarm or monitoring system interface for firearms, the alarm or monitoring system interface including:

(a) a base adapted to receive a firearm in a monitored position, the base providing a support surface upon which the firearm rests in the monitored position;

(b) an elongated sensor strap having a secured end and an unsecured end opposite to the secured end, the secured end being secured to the base and the unsecured end of the sensor strap comprising a first sensor half;

(c) a second sensor half mounted on the base in a position spaced apart from the secured end of the sensor strap to removeably receive the first sensor half in a received position in which (i) the unsecured end of the sensor strap remains unsecured to the base and (ii) the first sensor half forms a sensor link with the second sensor half;

(d) a deployment sensor switch adapted to reside in an armed state when the first sensor half and second sensor half form the sensor link, and to move to an alarm state when the first sensor half is moved with respect to the second sensor half so as to break the sensor link, the deployment sensor switch including an alarm/monitoring system connection for providing an input for an alarm/monitoring system; and (e) wherein at least one of the secured end of the elongated sensor strap or the second sensor half are located on the base support surface and the elongated sensor strap has a length sufficient to form a closed loop around a portion of the firearm in the monitored position with the first sensor half in the received position to form the sensor link with the second sensor half and the unsecured end of the sensor strap remaining unsecured to the base, the closed loop formed by the sensor strap in position to contact a portion of the firearm as the firearm is moved a triggering distance from the monitored position, such contact moving the first sensor half beyond an operational tolerance with respect to the second sensor half so as to break the sensor link between the first sensor half and second sensor half.

11. The apparatus of claim 10 further including a base tamper switch located at a bottom surface of the base opposite to the support surface, the base tamper switch adapted to reside in an armed position when the base rests with its bottom surface facing an external surface and to reside in an alarm state when the base bottom surface is separated from the external surface beyond a predefined distance.

12. The apparatus of claim 11 wherein the deployment sensor switch and the base tamper switch are connected in a common circuit to provide a single signal at the alarm system connection.

13. The apparatus of claim 10 wherein the deployment sensor switch is a normally open magnetic reed switch, wherein a reed activating magnet is included with the second sensor half, and wherein the sensor link is formed when the normally open magnetic reed switch comprising the deployment sensor switch is brought into operative proximity to the reed activating magnet.

14. The apparatus of claim 13 wherein the second sensor half includes a receptacle having an opening in the base support surface, and wherein the apparatus further includes a magnetic tamper switch located in operative proximity to the opening of the receptacle in the base support surface.

15. The apparatus of claim 14 further including a base tamper switch located at a bottom surface of the base opposite to the support surface, the base tamper switch adapted to reside in an armed position when the base rests with its bottom surface facing an external surface and to reside in an alarm state when the base bottom surface is separated from the external surface beyond a predefined distance, and wherein the deployment sensor switch, the base tamper switch, and the magnetic tamper switch are all connected in a common circuit to provide a single signal at the alarm system connection.

16. The apparatus of claim 15 further including a key-operated bypass switch connected in the common circuit in position to bypass the deployment sensor switch, base tamper switch, and magnetic tamper switch.

17. The apparatus of claim 10 further including a monitoring device having input terminals operatively connected to the deployment sensor switch, the monitoring device adapted to produce a monitoring signal on a transition from a first electrical condition across the deployment sensor switch to a second electrical condition.

18. The apparatus of claim 10 wherein the deployment sensor switch is mounted at the unsecured end of the sensor strap and comprises a normally open switch connected across two conductors extending through the sensor strap, and wherein a resistor is connected in one of the conductors adjacent to the deployment sensor switch.

* * * * *